US007437776B1

(12) United States Patent
Brown

(10) Patent No.: US 7,437,776 B1
(45) Date of Patent: Oct. 21, 2008

(54) BASKETBALL TRAINING GLOVE

(76) Inventor: Gordon D. Brown, 5988 W. Alameda Rd., Glendale, AZ (US) 85310

( * ) Notice: Subject to any disclaimer, the term of this patent is extended or adjusted under 35 U.S.C. 154(b) by 43 days.

(21) Appl. No.: 11/247,738

(22) Filed: Oct. 11, 2005

Related U.S. Application Data

(60) Provisional application No. 60/617,499, filed on Oct. 12, 2004.

(51) Int. Cl.
*A41D 19/00* (2006.01)

(52) U.S. Cl. ..... 2/160; 2/161.1

(58) Field of Classification Search ..... 2/160, 2/161.1–161.5; 128/880; 294/25; 473/205, 473/212
See application file for complete search history.

(56) References Cited

U.S. PATENT DOCUMENTS

| | | | | | |
|---|---|---|---|---|---|
| 2,852,779 | A * | 9/1958 | Roessler | ..... | 2/161.2 |
| 3,707,730 | A * | 1/1973 | Slider | ..... | 2/161.1 |
| 4,700,405 | A * | 10/1987 | Sternberg | ..... | 2/161.1 |
| 5,634,214 | A * | 6/1997 | St. Ville | ..... | 2/161.2 |
| 5,848,440 | A * | 12/1998 | Pajarola | ..... | 2/161.1 |

* cited by examiner

*Primary Examiner*—Katherine Moran
(74) *Attorney, Agent, or Firm*—Parsons & Goltry; Michael W. Goltry; Robert A. Parsons

(57) ABSTRACT

A basketball training glove includes a glove body having dorsal and palmar side panels, and opposing thumb and index finger stalls formed in the distal end. A strap is attached to the glove body and to the thumb stall, which maintains the thumb stall in proximity to the index finger stall and away from the palmer side panel.

5 Claims, 2 Drawing Sheets

Position B
Position A
100
101
102
104
105
108
109
110
111
112
113
116
117
118
119
120
121
122
123
124
126
141
142
143
145

BASKETBALL TRAINING GLOVE

CROSS REFERENCES TO RELATED APPLICATION

This application claims the benefit of provisional application Ser. No. 60/617,499, which was filed on Oct. 12, 2004.

FIELD OF THE INVENTION

This invention relates generally to gloves and, more particularly, to basketball training gloves.

BACKGROUND OF THE INVENTION

There are many different types of gloves which are used while playing sports and participating in other activities. These sports can include football, tennis, racquetball, golf, baseball, and basketball. The gloves are generally designed to improve performance and/or to provide protection while playing. For example, some gloves used in basketball are designed to help the person grip the basketball better. These gloves typically make it easier to grasp the basketball by expanding the person's hand periphery.

Other gloves used in basketball are designed to allow the person to shoot the basketball more accurately. For example, these gloves are designed to keep moisture from the person's hand so that the basketball does not undesirably slip during the shot. However, these gloves are generally not designed to help the shooter learn proper basketball shooting techniques. In the proper technique, the ball is maintained away from the palm or the shot is flat and less accurate. Further, if the thumb is maintained away from the ball during the shot, it is less likely to undesirably impart a sideways spin to it relative to its forward trajectory. This is because a sideways spinning ball often changes its trajectory and reduces the accuracy of the shot. Accordingly, there is a need for an improved glove which helps the shooter learn proper basketball shooting techniques.

BRIEF SUMMARY OF THE INVENTION

Disclosed is a basketball training glove which includes a glove body having opposing dorsal and palmar side panels, opposing proximal and distal ends, and a thumb stall. A strap is attached to the glove body and to the thumb stall and maintains the thumb stall in proximity to the glove body. In a preferred embodiment, the strap is attached to the dorsal side panel between the proximal and distal ends of the glove body. In one embodiment, the strap is substantially inflexible to limit movement of the thumb stall away from the glove body. In some embodiments, the glove body includes an index finger stall and the strap extends between the thumb and index finger stalls. In one embodiment, the strap maintains the thumb stall away from the palmar side panel. In some embodiments, the strap includes a first end attached to the glove body and an opposing second end. The second end of the strap is folded back onto the first end of the strap and secured thereto forming a loop in the strap. The loop is positioned toward the thumb stall and the thumb stall is positioned in the loop.

Also disclosed is a basketball training glove which includes a fitted glove body for receiving a human hand. The glove body includes a thumb stall and an index finger stall. A strap has an end coupled to the glove body and an opposed end. The thumb stall is moveable between a first position away from and a second position in proximity to the index finger stall. The thumb stall is maintained in the second position by the strap. In a preferred embodiment, the thumb stall is moveable in response to being captured by an intermediate portion, between the end and opposed ends, of the strap. In one embodiment, the end of the strap is coupled to a dorsal side panel of the glove body. In some embodiments, the thumb stall is moved from a position away from the end to a position towards the end in response to being captured by the strap. In one embodiment, the opposed end of the strap is moveable from a disengaged position away from the end and an engaged position coupled to the end for maintaining the thumb stall in the second position. In some embodiments, hook and loop medium couple the end and opposed ends of the strap together when the thumb stall is in the second position. In one embodiment, the strap extends between the thumb and index finger stalls and the strap loops around the thumb stall to capture it. In some embodiments, the strap includes an intermediate portion between the end and opposed ends of the strap. The end is coupled to the glove body and the intermediate portion loops around the thumb stall to maintain it in the second position. One of a fastening and complementary fastening elements is positioned proximate to the end of the strap and the other of the fastening and complementary fastening elements is positioned proximate to the opposed end of the strap.

Also disclosed is a basketball training glove which includes a glove body having a dorsal side panel and a palmar side panel. The glove body also includes a thumb stall and a plurality of finger stalls therebetween. An opening is positioned between the dorsal and palmar side panels to receive a human hand therein. One of the finger stalls includes an index finger stall opposing the thumb finger stall. A strap is attached to the glove body and thumb stall. The strap is adjustable to adjust the proximity of the thumb stall relative to the index finger stall. A spacer structure is carried by the dorsal side panel. In a preferred embodiment, the strap is moveable between a first position away from the thumb stall and a second position capturing the thumb stall. In one embodiment, an end and an opposed end of the strap are attached to the glove body to maintain the thumb stall in proximity to the index finger stall. In some embodiments, a fastener is attached to the end of the strap and a complementary fastener is attached to the opposed end. In one embodiment, the strap includes an intermediate portion between the end and opposed ends. The intermediate portion maintains the thumb stall in proximity to the index finger stall in response to the fastener and complementary fasteners being fastened together.

These and other features, aspects, and advantages of the present invention will become better understood with reference to the following drawings, description, and claims.

BRIEF DESCRIPTION OF THE DRAWINGS

Referring to the drawings.

DETAILED DESCRIPTION OF THE INVENTION

Figures 1, 2, 3:
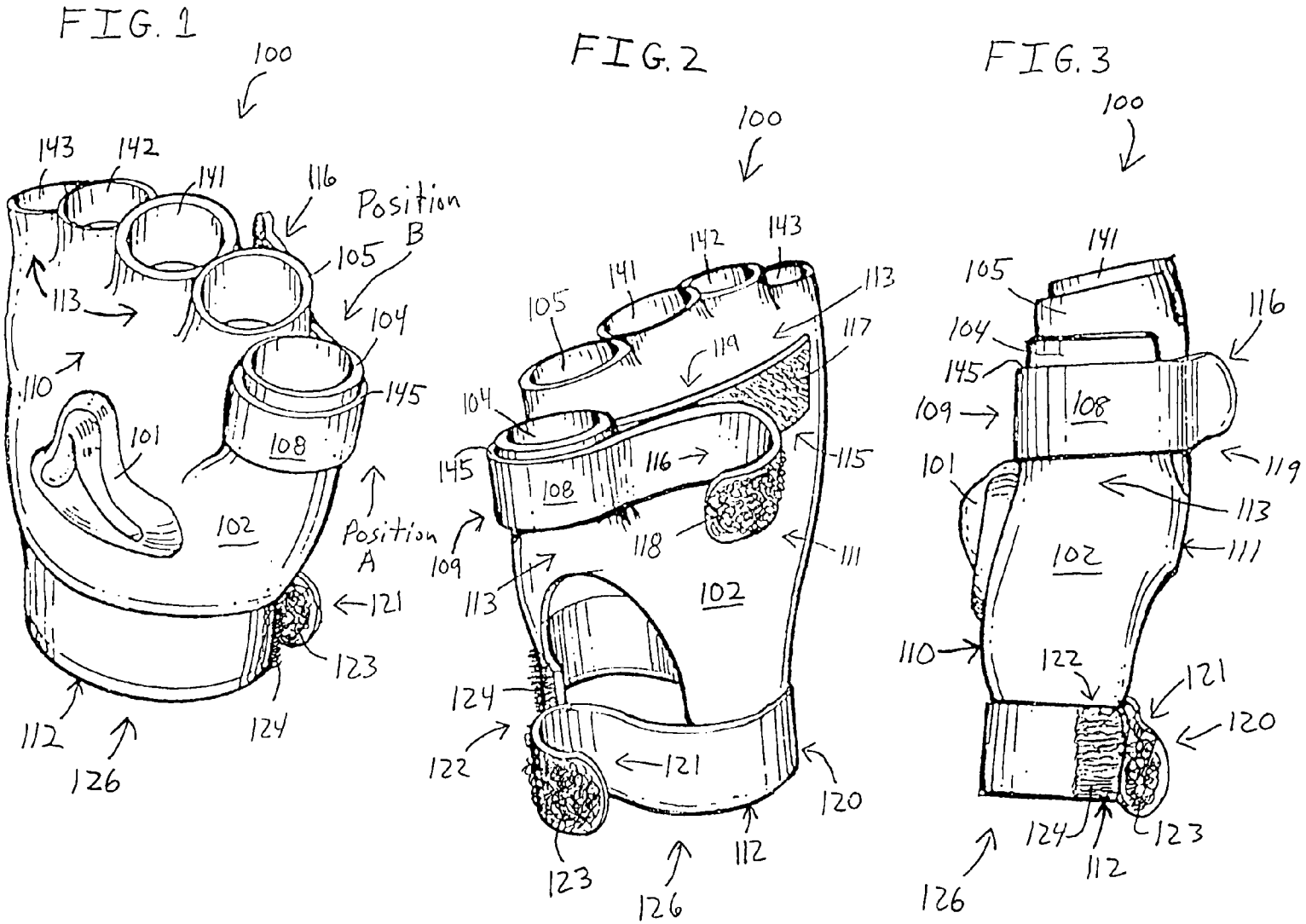
FIG. 1 is a front perspective view of a basketball training glove constructed and arranged in accordance with a principle of the invention.
FIG. 2 is a rear perspective view of the basketball training glove of FIG. 1.
FIG. 3 is a left side elevational view of the basketball training glove of FIG. 1.

Turning now to the drawings, in which like reference characters indicate corresponding elements throughout the several views, attention is directed to FIGS. 1-5 in which there is seen various views of a basketball glove 100 constructed and arranged in accordance with a principle of the invention. In this embodiment, glove 100 is a right hand glove. However, a glove constructed and arranged in accordance with the principle of the invention can be fashioned as a left hand glove without departing from the invention.

Figure 5:
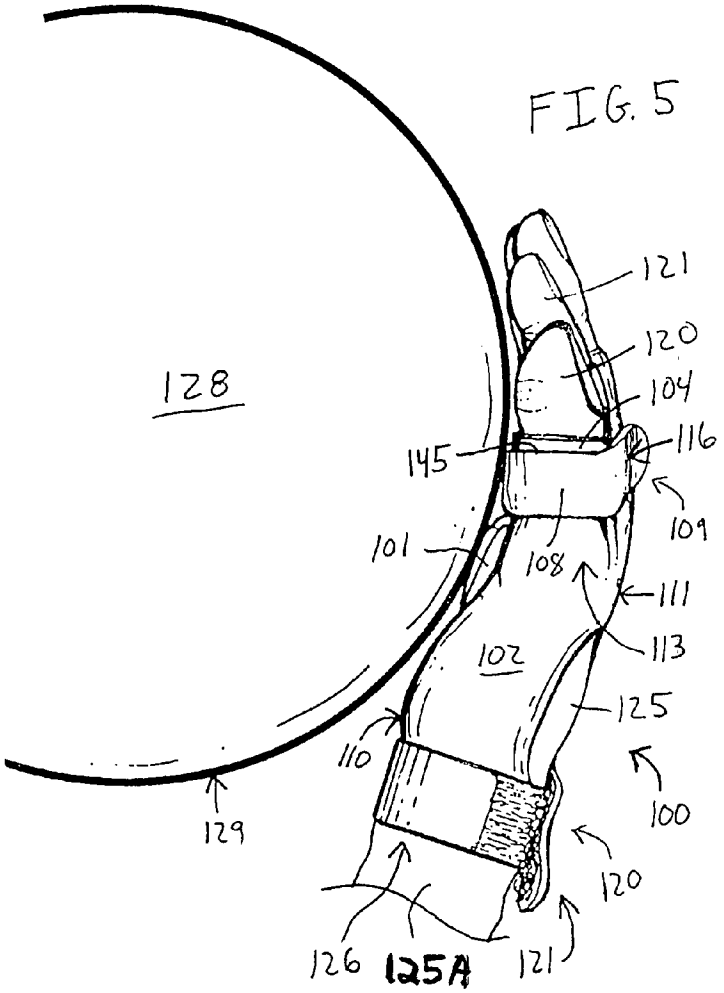
FIG. 5 is a left side elevational view of the basketball training glove of FIG. 1 shown as it would appear worn by a human hand positioned against a basketball.

Glove 100 includes a glove body 102 for receiving a human hand, and has a dorsal side panel 111, a palmar side panel 110, a proximal end 112, and an opposing distal end 113. An opening 126 is formed in proximal end 112 of glove body 102 for receiving a hand 125 of a person, as best seen in FIG. 5. A wrist strap 120 is positioned around an outer periphery of opening 126. Fastener and complementary fastener 123 and 124 are positioned proximate to ends 121 and 122, respectively, of wrist strap 120. Fastener and complementary fastener 123 and 124 include hook and loop medium and are moveable relative to each other to adjust a dimension of opening 126.

In this example, fastener 123 includes loop medium and complementary fastener 124 includes hook medium, although this order can be reversed, in which the hook and loop medium are together exemplary of a hook and loop fastener. The hook and loop medium are preferably of the type sold under the trademark Velcro®. In other examples, fastener and complementary fastener 117 and 118 can include other types of fasteners to provide closure, such as complementary snap fasteners, button fasteners, clasp fasteners, etc.

Further, fastener and complementary fastener 123 and 124 are repeatably moveable between engaged (FIGS. 3 and 4) and disengaged (FIG. 2) positions to provide opening 126 with a desired dimension. In this way, fastener and complementary fastener 123 and 124 are adjustable to adjust the force that proximal end 112 exerts against wrist 124. In this example, the force is adjustable by changing the overly between ends 121 and 122 in a well-known manner.

Glove body 102 also includes a thumb stall 104 and an index finger stall 105, both of which are formed in distal end 113 of glove body 102. In this example, glove body 102 further includes finger stalls 141, 142, and 143 for the middle, ring, and pinkie fingers, respectively. Thumb and index finger stalls 104 and 105 are positioned adjacent to each other and are for receiving a thumb 120 and index finger 121, respectively, of hand 125 (FIG. 5). In this embodiment, thumb stall 104 and finger stalls 105, 141, 142, and 143 partially cover their respective fingers, but they can cover them entirely in other examples.

Figure 4:
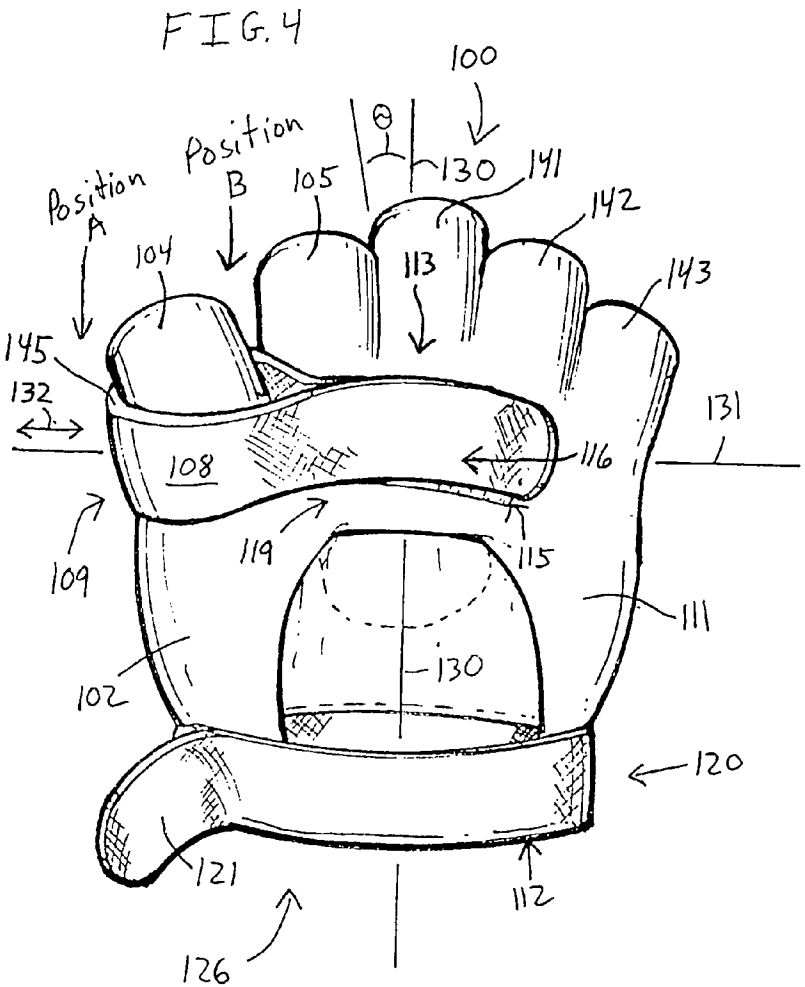
FIG. 4 is a rear elevational view of the basketball training glove of FIG. 1.

As will be discussed in more detail below, thumb stall 104 is moveable generally between a Position A away from index finger stall 105 and a Position B towards index finger stall 105 in a direction of motion as indicated by the double arrowed line designated at 132 (FIG. 4). Position B is towards index finger stall 105, and Position A is away from index finger stall 105. Position B is, moreover, generally away from palmar side panel 110 and towards dorsal side panel 111. By maintaining thumb stall 104 in Position B, thumb 120 in thumb stall 104 is prevented from exerting an undesired influence against a surface 129 of a basketball 128 (FIG. 5) during a shot, which improves the shot's accuracy. In other words, glove 10 is uniquely constructed and arranged so that when worn maintains a hand wearing glove 10 in a recommended hand position, which trains a user to shoot a basketball in accordance with recommended basketball shooting technique.

In accordance with the invention, glove 100 includes a thumb strap 109 coupled to glove body 102 and which is engagable to thumb stall 104 facilitates the movement of thumb stall 104 between Positions A and B and, moreover, movement of thumb stall 104 from Position A to Position B. When thumb stall 104 is captured by thumb strap 109 as will be presently described, it maintains thumb stall 104 in Position B and, moreover, in proximity relative to index finger stall 105. Thumb strap 109 is positioned at an intermediate location 119 between proximal and distal ends 112 and 113 of glove body 102, and extends across glove body 102 and between thumb stall 104 and index finger stall 105. Thumb strap 109 forms a loop 145, which encircles thumb stall 104 thereby maintaining thumb stall 104 in Position B, in accordance with the principle of the invention. Thumb strap 109 as a length which is chosen so that loop 145 will suitably loop around thumb stall 104 capturing thumb stall 104 to maintain in Position B, and limiting its movement out of Position B.

Thumb strap 109 extends at a substantially non-zero angle θ relative to a longitudinal axis 130 of glove body 102. Angle θ is preferably chosen so that it is along a reference line 131 generally perpendicular to axis 130. Reference line 131 preferably extends along the length of strap 109 when thumb stall 104 is in Position B.

Thumb strap 109 is elongate, and has opposed ends 115 and 116 and an intermediate portion 108 therebetween. End 115 is coupled to dorsal side panel 111 of glove body 102 and end 116 is a free end. End 115 extends across dorsal side panel 111, and is secured in place to glove body 102 with sewing, adhesive, or the like. Because end 115 is attached to glove body 102, end 115 may be considered an extension of glove body 102, as is end 116, which is attached to end 115 forming a loop 145 in thumb strap 109, which is directed toward thumb stall 104. In accordance with the invention, thumb stall 104 is positionable in loop 145 so as to move and maintain thumb stall 104 in Position B. Loop 145 is formed in intermediate portion 108 of thumb strap 109, and characterizes intermediate portion 108. In this example, intermediate portion 108 contacts thumb stall 104 when thumb strap 109 captures by it and maintains it in Position B and limits thumb stall 104 from moving out of Position B.

Ends 115 and 116 of thumb strap 109 are moveable between engaged (FIG. 4) and disengaged (FIG. 2) positions, in which when ends 115 and 116 are engaged to one another loop 145 is formed at intermediate portion 108. In the engaged position, thumb stall 104 is maintained by intermediate portion 108 in Position B when thumb stall 104 is captured by loop 145 at intermediate portion 108. When ends 115 and 116 are engaged, they are fastened together with a fastener 117 and a complementary fastener 118. Fastener 117 and complementary fastener 118 are attached to, and carried by, end 115 and free end 116, respectively, of thumb strap 109. Fastener 117 extends along a length of end 115 and complementary fastener 118 extends along a corresponding length of end 116.

In this example, fastener 117 is a hook medium and complementary fastener 118 is a loop medium, and this order can be reversed. As mentioned above, the hook and loop medium are preferably of the type sold under the trademark Velcro®. In other examples, fastener and complementary fastener 117 and 118 can include other types of fasteners to provide closure, such as complementary snap fasteners, button fasteners, clasp fasteners, etc.

In this embodiment, glove 100 includes a spacing structure 101 carried on palm side 110 of glove body 102. Spacing structure 101 preferably includes a piece of resilient material positioned to extend outwardly from palm side 110 at a generally central location. Spacing structure 101 is positioned to space basketball 128 away from palm side 110 for training a user to hold a basketball for shooting it in accordance with recommended technique. This is to get the person used to having ball 120 away from the palm of his or her hand. This increases the accuracy of the shot because the shot is not as flat. Spacing structure 101 is basically an enlarged protuberance, and its size, if desired, may be adjustable such as inflation and/or deflation.

It should be noted that glove 100 can be constructed using many different materials and utilizing fabrication methods standard within the art. Glove body 102 is preferably constructed with an elastic material designed to stretch slightly to allow glove 100 to fit many different sizes of hands and to place a slight bias on the person's hand 125 to hold it firmly in place. In this embodiment, glove body 102 includes leather with a rubber material forming palm side 111. The rubber material provides a desired friction between palmar side panel 110 and surface 129 of basketball 128. Glove 100 can also include other conventional materials, such as neoprene, plastic, elastic cloth, etc. Glove body 102 is preferably constructed as a single integral piece, but in other examples it can be constructed in multiple pieces that are attached together. The multiple pieces can be attached together in many different ways, such as by needlework, gluing, etc.

Thumb strap 109 and wrist strap 120 can also include many different types of materials. In this example, thumb strap 109 is fashioned of an inflexible material, such as nylon, and wrist strap 120 includes a flexible material, such as elastic cloth. Straps 109 and 120 are preferably formed separately from glove body 102 and then attached thereto. They can be attached in many different ways known in the art, such as by needlework, gluing, etc. Further, spacing structure 101 preferably includes a resilient material, such as rubber, plastic, etc., but it can include other conventional materials in other examples. Spacing structure 101 is preferably formed separately from glove body 102 and affixed to palmar side panel 110. In other examples, however, spacing structure 101 is formed integrally with glove body 102.

In operation, opening 126 receives the person's hand 125 and thumb stall 104 and index finger stall 105 receive the person's thumb 120 and index finger 121, respectively (FIG. 5). End 121 is moved towards end 122 of wrist strap 120 and complementary fastener 123 is engaged with fastener 124 so that wrist strap 120 provides a desired force between wrist 124 and proximal end 112 of glove 100. Thumb strap 109 is positioned so that it extends between stalls 104 and 105 and loops or wraps around thumb stall 104. End 116 of strap 109 is folded back and pulled towards end 115 to move thumb stall 104 from into Position B, such as from Position A. Complementary fastener 118 is moved from its disengaged position to an engaged position with fastener 117. In this way, loop 145 is formed in intermediate portion 108, which encircles thumb stall 104, whereby strap 109 maintains thumb stall 104 in position B, in which case thumb stall 104 is maintained in proximity to index finger stall 105 and away from palmar side panel 110 and moreover, towards dorsal side panel 111, as best seen in FIG. 5. Accordingly, thumb strap 109 is attached to glove body 102 and to the thumb stall 104 maintaining thumb stall 104 in Position B. The inflexibility of thumb strap 109 helps to ensure the thumb stall 104 will remain in Position B when glove 10 is worn and when thumb strap 109 is secured and capturing thumb stall 104 as herein described.

When a basketball is positioned at palmar side panel 110 of glove 10 when it is worn by a human hand, strap 109 maintaining thumb stall 104 in Position B prevents the user's thumb from introducing an undesired influence against the basketball during a shot, which improves the shot's accuracy. Also, spacing structure 101 at palmar side panel 110 presents up against the basketball and maintains it away from the palmar side panel 110 and, hence, the palm of the user's hand wearing glove 10, so that a user is forced to shoot the basketball from the tips of his fingers in accordance with recommended basketball shooting technique, rather than of the palm of the user's hand, in accordance with the principle of the invention. By using glove 10 repeatedly during training, a user will get used to holding his hand in the prescribed and recommended way as provided by glove 10, so that when glove 10 is not worn, such as during a basketball game, the user will be trained to hold the basketball in the manner provided by glove 10.

To remove glove 100 from the person's hand, the foregoing process for installing it is simply reversed. Complementary fastener 118 is disengaged from fastener 117 so that thumb stall 104 moves from Position B to Position A. Further, complementary fastener 123 is disengaged from fastener 124 to reduce the force between proximal end 112 and the person's wrist 124. Glove 100 is then removed from the person's hand 125 by withdrawing hand 125 from opening 126.

The present invention is described above with reference to a preferred embodiment. However, those skilled in the art will recognize that changes and modifications may be made in the described embodiment without departing from the nature and scope of the present invention. Various further changes and modifications will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A basketball training glove, comprising:

a glove body including opposing dorsal and palmar side panels, opposing proximal and distal ends, and a thumb stall formed in the distal end;

a first axis defined by the glove body extending from the proximal end of the glove body to the distal end of the glove body;

a strap having opposed first and second ends;

the first end of the strap secured to the dorsal side panel of the glove body, the strap extending across the dorsal side panel from the first end secured to the dorsal side panel of the glove body toward the thumb stall between the proximal and distal ends of the glove body along a second axis substantially perpendicular to the first axis;

the second end of the strap folded back onto the first end of the strap and secured thereto to form a loop in the strap positioned toward the thumb stall;

the second end of the strap extending across the first end of the strap along the second axis; and the thumb stall positioned in the loop securing the thumb stall to the strap, the strap maintaining the thumb stall in proximity to the glove body and away from the palmar side panel.

2. The glove of claim 1, wherein the strap is substantially inflexible limiting movement of the thumb stall away from the glove body and toward the palmar side of the glove body.

3. The glove of claim 1, further including an index finger stall formed in the distal end of the glove body, wherein the strap extends between the thumb and index finger stalls.

4. The glove of claim 1, spacer structure attached to the palmar side panel of the glove body for maintaining a basketball away from the palmar side panel of the glove body.

5. The glove of claim 1, further comprising an engagement assembly securing the second end of the strap to the first end of the strap including an element thereof carried by the second end of the strap secured to a complemental element thereof carried by the first end of the strap.

* * * * *